US006180580B1

(12) United States Patent
Ardia et al.

(10) Patent No.: US 6,180,580 B1
(45) Date of Patent: Jan. 30, 2001

(54) SOAKER COMPOSITIONS

(75) Inventors: Gabriella Ardia; Stefano Scialla, both of Rome (IT)

(73) Assignee: The Procter & Gamble Company, Cincinnati, OH (US)

( * ) Notice: Under 35 U.S.C. 154(b), the term of this patent shall be extended for 0 days.

(21) Appl. No.: 09/380,036

(22) PCT Filed: Feb. 13, 1998

(86) PCT No.: PCT/US98/02719

§ 371 Date: Aug. 25, 1999

§ 102(e) Date: Aug. 25, 1999

(87) PCT Pub. No.: WO98/38271

PCT Pub. Date: Sep. 3, 1998

(30) Foreign Application Priority Data

Feb. 27, 1997 (EP) ..... 97870027

(51) Int. Cl.[7] ..... C11D 1/66; C11D 3/00; C11D 7/18; C11D 7/54

(52) U.S. Cl. ..... 510/309; 510/283; 510/375; 510/376; 510/536

(58) Field of Search ..... 510/283, 309, 510/367, 372, 375, 376, 427, 535, 536

(56) References Cited

U.S. PATENT DOCUMENTS 3,929,678 * 12/1975 Laughlin et al. ..... 252/526
4,134,838 * 1/1979 Hooper et al. ..... 252/8.8
4,486,327 * 12/1984 Murphy et al. ..... 252/94
6,087,313 * 7/2000 Ardia et al. ..... 510/309

FOREIGN PATENT DOCUMENTS 0 736 594 * 10/1996 (EP) .
0 736 597 * 10/1996 (EP) .

* cited by examiner

*Primary Examiner*—Yogendra Gupta
*Assistant Examiner*—John M Petruncio
(74) *Attorney, Agent, or Firm*—R. S. Echler, Sr.; I. S. Robinson; K. W. Zerby

(57) ABSTRACT

Soaking compositions are disclosed which comprise oxygen bleach, a sorbitan ester in combination with an alkyl sulphonate surfactant. Said compositions are diluted in water to form soaking liquors. The invention is particularly effective in removing particulate soils like silt and clay from fabrics as well as enzymatic stains and bleachable stains.

20 Claims, No Drawings

SOAKER COMPOSITIONS

TECHNICAL FIELD

The present invention relates to the cleaning of fabrics in soaking conditions, i.e., in conditions where the fabrics are left to soak in a soaking liquor comprising water and detergent ingredients, typically without undergoing any mechanical agitation, either as a first step before a typical washing operation, or as a single step.

BACKGROUND OF THE INVENTION

Fabric soaking operations have been described in the art. In such soaking operations, fabrics are left in contact with a soaking liquor for a prolonged period of time typically ranging from a few minutes to overnight or even 24 hours. This laundering process has the advantage that it maximises the contact time between the fabrics and the key active ingredients of the soaking liquor. It also has the advantage that it reduces or eliminates the need for a typical laundering operation involving the need for mechanical agitation, or that it improves the efficiency of the subsequent typical laundering operation.

Such soaking operations are typically desirable to remove tough outdoor dirt from fabrics, such as particulate soil like mud, silt and/or clays. For example, clays usually have a microcrystalline mineral structure (e.g., hydrous aluminium silicate like illite, montmorillonite, kaolinite and the like) with the presence of an organic fraction. The organic fraction can contain a variety of compounds (e.g., humic acid, fulvic acid, plant/animal biomass and the like). Clays can also contain several kinds of metals (e.g., magnesium, calcium, potassium, iron and the like). However, such particulate soil is particularly difficult to remove from fabrics. Indeed, it is believed that the very fine dirt grains like clays or silt, typically below 0.002 mm in size, can insert among fabric fibers and steadily stick to the surface of the fibers. This problem is particularly acute with socks which are most exposed to silt and clay pick-up. Also such soaking operations are not fully satisfactory regarding the stain removal performance delivered on enzymatic stains or even on bleachable stains. Enzymatic stains are typically composed of carbohydrates and proteinaceus soil, like blood. It has now been observed that enzymatic stains may act as a glue for particulate soil on fabrics, thus removing such enzymatic stains may facilitate the removal of particulate soil from fabrics.

It is thus an object of the present invention to improve the stain removal of particulate soils, mud and/or clay, as well as of enzymatic stains and bleachable stains.

It has been found that this object can be met by soaking fabrics in an aqueous soaking liquor comprising an effective amount of a granular soaking detergent composition comprising an oxygen bleach, an anionic surfactant of the formula R-SO3M, wherein R is a substituted or unsubstituted, saturated or unsaturated, linear or branched hydrocarbon chain having from 6 to 40 carbon atoms and M is H or a cation, and a sorbitan ester, as described herein after. Indeed, it has been found that by combining sorbitan ester and such an anionic surfactant as described herein, on top of an oxygen bleach, in a soaking composition, improved stain removal performance is delivered on stains like tough outdoor dirt like particulate soil, bleachable stains as well as enzymatic stains, when used under soaking conditions (i.e., when left in contact for prolonged period of time typically up to 24 hours), as compared to the stain removal performance delivered with the same composition being free of such a sorbitan ester and/or anionic surfactant as described herein.

An advantage of the present invention is that not only improved particulate soil removal performance is delivered but also that the soil redeposition on fabrics in prolonged soaking condition is prevented. Furthermore, the soaking compositions of the present invention comprising sorbitan ester, such an anionic surfactant and oxygen bleach also provide effective stain removal performance on other types of stains like greasy stains, e.g., dirty motor oil, spaghetti sauce.

An advantage of the present invention is that the stain removal performance, when soaking a fabric in presence of a soaking composition comprising an oxygen bleach, such an anionic surfactant and a sorbitan ester, is improved even in the presence of relatively high levels of hardness ions. Indeed, the presence of hardness ions (calcium or magnesium ions), which occur naturally in the soaking liquor, in particular, can reduce surfactant performance and eventually precipitate the surfactant from the soaking liquor as a calcium or magnesium salt. This phenomen occurs less when using a sorbitan ester together with an anionic sulphonate surfactant as defined herein. Accordingly, the soaking detergent manufacturer may make use of builders which are not the more performing at sequestering free hardness ions, and thus may use less expensive builders in such a soaking composition.

BACKGROUND ART

EP-A-736 594 discloses soaking compositions comprising a sorbitan ester in combination with a high amount of a building and soil suspending system comprising a compound selected from citric acid or citrates, silicates, zeolites, polycarboxylates phosphates and mixtures thereof. Oxygen bleach are include amongst the optional ingredients. No anionic surfactants according to the formula as described herein are disclosed, nor exemplified.

EP-A-736 597 discloses soaking compositions comprising oxygen bleach, builders, anionic surfactants, proteolytic enzymes and stability enhanced amylase enzyme. No sorbitan esters are disclosed.

SUMMARY OF THE INVENTION

The present invention encompasses a granular soaking composition comprising:

from 0.001% to 15% by weight of the total composition of a sorbitan ester according to the formula $C_6H_9O_2(C_2H_4O)_x R_1R_2R_3$, wherein x is an integer of from 0 to 40, $R_1$, $R_2$ are independently OH or $(C_nH_{2n+}1)COO$, and $R_3$ is $(C_nH_{2n+1})COO$ group, where n is an integer of from 11 to 17, from 0.001 % to 20% by weight of the total composition of an anionic surfactant of the formula R-SO3M, wherein R is a substituted or unsubstituted, saturated or unsaturated, linear or branched hydrocarbon chain having from 6 to 40 carbon atoms and M is H or a cation, and an oxygen bleach.

The present invention further encompasses a process of soaking fabrics, wherein said fabrics are immersed in a soaking liquor comprising water and an effective amount of a composition as described herein above, for an effective period of time, then removed from said soaking liquor.

DETAILED DESCRIPTION OF THE INVENTION

The present invention encompasses a composition and a process of soaking fabrics. The composition, hereinafter referred to as the soaking composition, is used in the soaking process.

A-The composition:

The granular compositions herein comprises at least a sorbitan ester, a particular anionic surfactant as defined herein and an oxygen bleach.

The Sorbitan Ester

Accordingly, the first essential ingredient of the compositions of the present invention is a sorbitan ester according to the formula $C_6H_9O_2$ $(C_2H_4O)_x$ $R_1R_2R_3$, wherein x is an integer of from 0 to 40, $R_1$, $R_2$ are independently OH or $(C_n H_{2n+1})COO$, and $R_3$ is $(C_n H_{2n+}1)COO$ group, where n is an integer of from 11 to 17.

In the preferred compositions herein, x is 0 or 20, and the most preferred compositions herein comprise polyethoxylated (20) sorbitan tristearate, i.e. $C_6H_9O_2$ $(C_2H_4O)_{20}$ $(C_{17} H_{35}COO)_3$, or polyethoxylated (20) sorbitan monostearate, i.e. $C_6H_9O_2$ $(C_2H_4O)_{20}(OH)_2(C_{17} H_{35}COO)$, or sorbitan monostearate, i.e. $C_6H_9O_2(OH)_2(C_{17} H_{35}COO)$, Or sorbitan monopalmitate, i.e. $C_6H_9O_2(OH)_2(C_{15} H_{31}COO)$, or mixtures thereof.

All these materials are commercially available under several trade names, such as Glycosperse TS 20 from Lonza (polyethoxylated sorbitan tristearate), Glycosperse S 20 from Lonza (polyethoxylated sorbitan monostearate), Radiasurf 7145 from Fina (sorbitan monostearate), Radiasurf 7135 from Fina (sorbitan monopalmitate), Armotan MP from Akzo (sorbitan monopalmitate).

It has further been found that combining ethoxylated sorbitan esters with non-ethoxylated sorbitan esters provides better performance than either kind alone.

The soaking compositions herein comprise from 0.001% to 15% by weight of the total composition of said sorbitan ester or mixtures thereof, preferably from 0.01% to 10%, more preferably from 0.1% to 5% and most preferably from 0.5% to 4%.

The Anionic Surfactant

The second essential ingredient of the compositions of the present invention is an anionic surfactant of the formula R-SO3M, wherein R is a substituted or unsubstituted, saturated or unsaturated, linear or branched hydrocarbon chain having from 6 to 40 carbon atoms and M is H or a cation.

Preferably R is a substituted or unsubstituted, saturated or unsaturated, linear or branched alkyl group having from 6 to 40 carbon atoms, preferably from 8 to 30, more preferably from 10 to 25 and most preferably from 11 to 20. Preferably M is a cation which can be for example a metal cation (e.g., sodium, potassium, lithium, calcium, magnesium etc), ammonium or substituted-ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine and mixtures thereof and the like).

Suitable anionic sulphonates to used herein are sodium paraffin sulphonates like C12–C14 paraffin sulphonates and/or C14–C16 paraffin sulphonates. They may be commercially available from Hoescht under the name Hostapur ®.

The soaking compositions herein comprise from 0.001% to 20% by weight of the total composition of said anionic surfactant, as defined herein or mixtures thereof, preferably from 0.01 % to 15 %, more preferably from 0.1% to 10% and most preferably from 0.5% to 5 %.

The Oxygen Bleach

As a third essential ingredient, the compositions according to the present invention comprise an oxygen bleach or a mixture thereof. Indeed, oxygen bleaches provide a multitude of benefits such as bleaching of stains, deodorization, as well as disinfectancy. The sorbitan esters and anionic sulphonates according to the present invention have a further particular advantage that they are resistant to oxydation by oxygen bleaches. The oxygen bleach in the composition may come from a variety of sources, such as hydrogen peroxide or any of the addition compounds of hydrogen peroxide, or organic peroxyacid, or mixtures thereof. By addition compounds of hydrogen peroxide, it is meant compounds which are formed by the addition of hydrogen peroxide to a second chemical compound, which may be for example an inorganic salt, urea or organic carboxylate, to provide the addition compound. Examples of the addition compounds of hydrogen peroxide include inorganic perhydrate salts, the compounds hydrogen peroxide forms with organic carboxylates, urea, and compounds in which hydrogen peroxide is clathrated.

Examples of inorganic perhydrate salts include perborate, percarbonate, perphosphate and persilicate salts. The inorganic perhydrate salts are normally the alkali metal salts. The alkali metal salt of percarbonate, perborate or mixtures thereof, are the preferred inorganic perhydrate salts for use herein. Preferred alkali metal salt of percarbonate is sodium percarbonate.

Other suitable oxygen bleaches include persulphates, particularly potassium persulphate $K_2S_2O_8$ and sodium persulphate $Na_2S_2O_8$. Examples of inorganic perhydrate salts include perborate, percarbonate, perphosphate and persilicate salts. The inorganic perhydrate salts are normally the alkali metal salts.

Typically, the soaking compositions in the present invention comprise from 0.01% to 80% by weight of the total composition of an oxygen bleach or mixtures thereof, preferably from 5% to 45% and more preferably from 10% to 40%.

The soaking compositions of the present invention are granular compositions. This compositions can be made by a variety of methods well known in the art, including dry-mixing, spray drying, agglomeration and granulation and combinations thereof. The compositions herein can be prepared with different bulk densities, from conventional granular products to so called "concentrated" products (i.e., with a bulk density above 600g/l).

Optional Ingredients

The soaking compositions of the present invention may further comprise a variety of other ingredients.

Preferably the compositions herein further comprise a bleach activator or a mixture thereof up to 30% by weight of the total composition. Examples of suitable compounds of this type are disclosed in British Patent GB 1 586 769 and GB 2 143 231. Preferred examples of such compounds are tetracetyl ethylene diamine, (TAED), sodium 3, 5, 5 trimethyl hexanoyloxybenzene sulphonate, diperoxy dodecanoic acid as described for instance in U.S. Pat. No. 4,818, 425 and nonylamide of peroxyadipic acid as described for instance in U.S. Pat. No. 4,259, 201 and n-nonanoyloxybenzenesulphonate (NOBS), and acetyl triethyl citrate (ATC) such as described in European patent application 91870207.7. Also particularly preferred are N-acyl caprolactam selected from the group consisting of substituted or unsubstituted benzoyl caprolactam, octanyl caprolactam, nonanoyl caprolactam, hexanoyl caprolactam, decanoyl caprolactam, undecenoyl caprolactam, formyl caprolactam, acetyl caprolactam, propanoyl caprolactam, butanoyl caprolactam pentanoyl caprolactam. The soaking compositions herein may comprise mixtures of said bleach activators.

Preferred mixtures of bleach activators herein comprise n-nonanoyloxybenzenesulphonate (NOBS) together with a second bleach activator having a low tendency to generate diacyl peroxide, but which delivers mainly peracid. Said second bleach activators may include tetracetyl ethylene diamine (TAED), acetyl triethyl citrate (ATC), acetyl caprolactam, benzoyl caprolactam and the like, or mixtures thereof. Indeed, it has been found that a mixture of bleach activators comprising n-nonanoyloxybenzenesulphonate and said second bleach activator added in the soaking compositions of the present invention, contribute to further boost the particulate soil removal performance of said compositions while exhibiting at the same time good performance on diacyl peroxide sensitive soil (e.g., beta-carotene) and on peracid sensitive soil (e.g., body soils).

Accordingly, the soaking compositions herein may comprise from 0% to 15% by weight of the total composition of n-nonanoyloxybenzenesulphonate, preferably from 1% to 10% and more preferably from 3% to 7% and from 0% to 15% by weight of the total composition of said second bleach activator preferably from 1% to 10% and more preferably from 3% to 7%.

The compositions herein may comprise an acidifying system amongst the preferred optional ingredients. The purpose of said acidifying system is to control the alkalinity generated by the source of available oxygen and any alkaline compounds present in the wash solution. Said system comprises anhydrous acidifying agent, or mixtures thereof, which needs to be incorporated in the product in an anhydrous form, and to have a good stability in oxidizing environment. Suitable anhydrous acidifying agents for use herein are carboxylic acids such as citric acid, adipic acid, glutaric acid, 3 chetoglutaric acid, citramalic acid, tartaric acid and maleic acid or their salts or mixtures thereof. Other suitable acidifying agents include sodium bicarbonate, sodium sesquicarbonate and silicic acid. Highly preferred acidifying systems to be used herein comprise citric acid and/or sodium citrate. Indeed, citric acid can be used in its acidic form or in the form of its salts (mono-, di-, tri- salts) and in all its anhydrous and hydrated forms, or mixtures thereof. It may additionally act as a builder and a chelant, and it is biodegradable. The compositions according to the present invention comprise from up to 20% by weight of the total composition of anhydrous citric acid, preferably from 5% to 15%, most preferably about 10%.

The compositions herein may comprise an alkali metal salt of silicate, or mixtures thereof, amongst the preferred optional ingredients. Preferred alkali metal salt of silicate to be used herein is sodium silicate. In the preferred embodiment herein wherein the soaking compositions comprise an oxygen bleach, it has been found that the decomposition of available oxygen produced in the soaking liquors upon dissolution of the soaking compositions is reduced by the presence of at least 40 parts per million of sodium silicate in said soaking liquors.

Any type of alkali metal salt of silicate can be used herein, including the crystalline forms as well as the amorphous forms of said alkali metal salt of silicate or mixtures thereof.

Suitable crystalline forms of sodium silicate to be used are the crystalline layered silicates of the granular formula:

$$NaMSi_xO_{2x+1}.yH_2O$$

wherein M is sodium or hydrogen, x is a number from 1.9 to 4 and y is a number from 0 to 20, or mixtures thereof. Crystalline layered sodium silicates of this type are disclosed in EP-A-164 514 and methods for their preparation are disclosed in DE-A-34 17 649 and DE-A-37 42 043. For the purposes of the present invention, x in the general formula above has a value of 2, 3 or 4 and is preferably 2. More preferably M is sodium and y is 0 and preferred examples of this formula comprise the a, b, g and d forms of $Na_2Si_2O_5$ These materials are available from Hoechst AG FRG as respectively NaSKS-5, NaSKS-7, NaSKS-11 and NaSKS-6. The most preferred material is d—$Na_2Si_2O_5$, NaSKS-6. Crystalline layered silicates are incorporated in soaking compositions herein, either as dry mixed solids, or as solid components of agglomerates with other components.

Suitable amorphous forms of sodium silicate to be used herein have the following general formula:

$$NaMSi_xO_{2x+1}$$

wherein M is sodium or hydrogen and x is a number from 1.9 to 4, or mixtures thereof. Preferred to be used herein are the amorphous forms of $Si_2O_5$ $Na_2O$.

Suitable Zeolites for use herein are aluminosilicates including those having the empirical formula:

$$Mz(zAlO2.ySiO2)$$

wherein M is sodium, potassium, ammonium or substituted ammonium, z is from about 0.5 to about 2; and y is 1; this material having a magnesium ion exchange capacity of at least about 50 milligram equivalents of CaCO3 hardness per gram of anhydrous aluminosilicate. Preferred zeolites which have the formula:

$$Nazí(AlO2)z(SiO2)yù.xH2O$$

wherein z and y are integers of at least 6, the molar ratio of z to y is in the range from 1.0 to about 0.5, and x is an integer from about 15 to about 264.

Useful materials are commercially available. These aluminosilicates can be crystalline or amorphous in structure and can be naturally-occurring aluminosilicates or synthetically derived. A method for producing aluminosilicate ion exchange materials Is disclosed in U.S. Pat. No. 3,985,669, Krummel, et al, issued Oct. 12,. 1976. Preferred synthetic crystalline aluminosilicate ion exchange materials useful herein are available under the designations Zeolite A, Zeolite P (B), and Zeolite X. In an especially preferred embodiment, the crystalline aluminosilicate ion exchange material has the formula:

$$Na12í(AlO2)12(SiO2)12ù.xH2O$$

wherein x is from 20 to 30, especially about 27. This material is known as Zeolite A. Preferably, the aluminosilicate has a particle size of about 0.1–10 microns in diameter.

Typically, the compositions herein may comprise from 0.5% to 15% by weight of the total composition of an alkali metal salt of silicate or mixtures thereof, preferably from 1% to 10% and more preferably from 2% to 7%.

The composition herein may also comprise a builder amongst the preferred optional ingredients. All builders known to those skilled in the art may be used herein. Suitable phosphate builders for use herein include sodium and potassium tripolyphosphate, pyrophosphate, polymeric metaphosphate having a degree of polymerization of from about 6 to 21, and orthophosphate. Other phosphorus builder compounds are disclosed in U.S. Pat. Nos. 3,159,581; 3,213,030; 3,422,021; 3,422,137; 3,400,176 and 3,400,148, incorporated herein by reference.

Suitable polycarboxylate builders for use herein include ether polycarboxylates, including oxydisuccinate, as disclosed in Berg, U.S. Pat. No. 3,128,287, issued Apr. 7, 1964, and Lamberti et al, U.S. Pat. No. 3,635,830, issued Jan. 18, 1972. See also "TMS/TDS" builders of U.S. Pat. No. 4,663,071, issued to Bush et al, on May 5, 1987. Suitable ether polycarboxylates also include cyclic compounds, particularly alicyclic compounds, such as those described in U.S. Pat. Nos. 3,923,679; 3,835,163; 4,120,874 and 4,102,903.

Other useful detergency builders include the ether hydroxypolycarboxylates, 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Also suitable in the soaking compositions of the present invention are the 3,3-dicarboxy4-oxa-1,6-hexanedioates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200.263, published Nov. 5, 1986.

Other suitable polycarboxylate builders are disclosed in U.S. Pat. No. 4,144,226, Crutchfield et al, issued Mar. 13, 1979 and in U.S. Pat. No. 3,308,067, Diehl, issued Mar. 7, 1967. See also Diehl U.S. Pat. No. 3,723,322.

Other suitable polycarboxylate builders for use herein include builders according to formula I

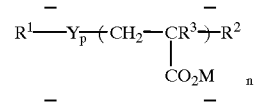

I wherein Y is a comonomer or comonomer mixture; $R^1$ and $R^2$ are bleach—and alkali-stable polymer-end groups; $R^3$ is H, OH or $C_{1-4}$ alkyl; M is H, alkali metal, alkaline earth metal, ammonium or substituted ammonium; p is from 0 to 2; and n is at least 10, or mixtures thereof.

Preferred polymers for use herein fall into two categories. The first category belongs to the class of copolymeric polymers which are formed from an unsaturated polycarboxylic acid such as maleic acid, citraconic acid, itaconic acid, mesaconic acid and salts thereof as first monomer, and an unsaturated monocarboxylic acid such as acrylic acid or an alpha —$C_{1-4}$ alkyl acrylic acid as second monomer. Referring to formula I hereinabove, the polymers belonging to said first class are those where p is not 0 and Y is selected from the acids listed hereinabove. Preferred polymers of this class are those according to formula I hereinabove, where Y is maleic acid. Also, in a preferred embodiment, $R^3$ and M are H, and n is such that the polymers have a molecular weight of from 1000 to 400 000 atomic mass units.

The second category of preferred polymers for use herein belongs to the class of polymers in which, referring to formula I hereinabove, p is 0 and $R^3$ is H or $C_{1-4}$ alkyl. In a preferred embodiment n is such that the polymers have a molecular weight of from 1000 to 400 000 atomic mass units. In a highly preferred embodiment, R3 and M are H.

The alkali-stable polymer end groups $R^1$ and $R^2$ in formula I hereinabove suitably include alkyl groups, oxyalkyl groups and alkyl carboxylic acid groups and salts and esters thereof.

In the above, n, the degree of polymerization of the polymer can be determined from the weight average polymer molecular weight by dividing the latter by the average monomer molecular weight. Thus, for a maleic-acrylic copolymer having a weight average molecular weight of 15,500 and comprising 30 mole % of maleic acid derived units, n is 182 (i.e. 15,500/(116×0.3 +72×0.7)).

Temperature-controlled columns at 40° C. against sodium polystyrene sulphonate polymer standards, available from Polymer Laboratories Ltd., Shropshire, UK, the polymer standards being 0.15M sodium dihydrogen phosphate and 0.02M tetramethyl ammonium hydroxide at pH 7.0 in 80/20 water/acetonitrile.

Of all the above, highly preferred polymers for use herein are those of the first category in which n averages from 100 to 800, preferably from 120 to 400.

Preferred builders for use herein are polymers of maleic or acrylic acid, or copolymers of maleic and acrylic acid.

Typically, the compositions of the present invention comprise up to 50% by weight of the total composition of a builder or mixtures thereof, preferably from 0.1 % to 20% and more preferably from 0.5 to 11 %.

Preferably the soaking compositions herein further comprise a chelating agent or mixtures thereof. Chelating agents are desired herein as they help to control the level of free heavy metal ions in the soaking liquors, thus avoiding rapid decomposition of the oxygen released by oxygen bleach. Suitable amino carboxylate chelating agents which may be used herein include diethylene triamino pentacetic acid, ethylenediamine tetraacetates (EDTA), N-hydroxyethylethylenediamine triacetates, nitrilotriacetates, ethylenediamine tetraproprionates, triethylenetetraamine hexaacetates, and ethanoldiglycines, alkali metal ammonium and substituted ammonium salts thereof or mixtures thereof. Further suitable chelating agents include ethylenediamine-N,N'-disuccinic acids (EDDS) or alkali metal, alkaline earth metal, ammonium, or substituted ammonium salts thereof. Particularly suitable EDDS compounds are the free acid form and the sodium or magnesium salt or complex thereof. Also others suitable chelating agents may be the organic phosphonates, including amino alkylene poly(alkylene phosphonate), alkali metal ethane 1-hydroxy diphosphonates, nitrilo trimethylene phosphonates, ethylene diamine tetra methylene phosphonates and diethylene triamine penta methylene phosphonates. The phosphonate compounds may be present either in their acid form or in the form of their metal alkali salt. Preferably, the organic phosphonate compounds where present are in the form of their magnesium salt.

The soaking compositions in the present invention may accordingly comprise from 0% to 5% by weight of the total compositions of said chelating agents, preferably from 0% to 3%, more preferably from 0.05% to 2%.

The soaking compositions herein may also comprise other surfactants on top of the sorbitan ester and said anionic sulphonate as described herein before. Such surfactants may be desirable as they may further contribute to the benefit of the compositions herein: i.e., improved stain removal on particulate soils as well as other types of soils like enzymatic, grease and the like.

Such surfactants may be present in the soaking compositions according to the present invention, on top of sorbitan ester and the anionic surfactant as described herein before, in amounts of from 0.1% to 50% by weight of the total composition, preferably of from 0.1 % to 20% and more preferably of from 1% to 10%. Surfactants to be used herein include nonionic surfactants, anionic surfactants, cationic surfactants, amphoteric surfactants, zwitterionic surfactants, and mixtures thereof.

Suitable anionic surfactant for use herein include water soluble salts or acids of the formula $ROSO_3M$ wherein R preferably is a $C_{10}$–$C_{24}$ hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quarternary ammonium cations derived from alkylamines such as ethylamine, diethylamine, triethylamine, and mixtures thereof, and the like). Typically, alkyl chains of $C_{12-16}$ are preferred for lower wash temperatures (e.g., below about 50° C.) and $C_{16-18}$ alkyl chains are preferred for higher wash temperatures (e.g., above about 50° C.).

Other suitable anionic surfactants for use herein are water soluble salts or acids of the formula $RO(A)_mSO_3M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethyl-ammonium and quaternary ammonium cations, such as tetramethyl-ammonium, dimethyl piperdinium and cations derived from alkanolamines such as ethylamine, diethylamine, triethylamine, mixtures thereof, and the like. Exemplary surfactants are $C_{12}$–$C_{18}$ alkyl polyethoxylate (1.0) sulfate, $C_{12}$–$C_{18}$E(1.0)M), $C_{12}$–$C_{18}$ alkyl polyethoxylate (2.25) sulfate, $C_{12}$–$C_{18}$E(2.25)M), $C_{12}$–$C_{18}$ alkyl polyethoxylate (3.0) sulfate $C_{12}$–$C_{18}$E(3.0), and $C_{12}$–$C_{18}$ alkyl polyethoxylate (4.0) sulfate $C_{12}$–$C_{18}$E(4.0)M), wherein M is conveniently selected from sodium and potassium.

Other anionic surfactants useful for detersive purposes can also be used herein. These can include salts (including, for example, sodium, potassium, ammonium, and substituted ammonium salts such as mono-, di- and triethanolamine salts) of soap, $C_9$–$C_{20}$ linear alkylbenzenesulfonates, $C_{8-C24}$ olefinsulfonates, sulfonated polycarboxylic acids prepared by sulfonation of the pyrolyzed product of alkaline earth metal citrates, e.g., as described in British patent specification No. 1,082,1 79, $C_8$–$C_{24}$ alkylpolyglycolethersulfates (containing up to 10 moles of ethylene oxide); alkyl ester sulfonates such as $C_{14-16}$ methyl ester sulfonates; acyl glycerol sulfonates, fatty oleyl glycerol sulfates, alkyl phenol ethylene oxide ether sulfates, alkyl phosphates, isethionates such as the acyl isethionates, N-acyl taurates, alkyl succinamates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), acyl sarcosinates, sulfates of alkylpolysaccharides such as the sulfates of alkylpolyglucoside (the nonionic nonsulfated compounds being described below), branched primary alkyl sulfates, alkyl polyethoxy carboxylates such as those of the formula $RO(CH_2CH_2O)_kCH_2COO—M^+$ wherein R is a $C_8$–$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23 (herein incorporated by reference).

Suitable nonionic surfactants to be used herein are typically alkoxylated nonionic surfactants according to the formula $RO—(A)_nH$, wherein R is a substituted or unsubstituted, saturated or unsaturated, linear or branched hydrocarbon chain having from 6 to 40 carbon atoms, A is an alkoxy group having from 2 to 10 carbon atoms, and wherein n is an integer from 9 to 100.

Preferably R is a substituted or unsubstituted, saturated or unsaturated, linear or branched alkyl group or aryl group having from 8 to 30 carbon atoms, preferably from 10 to 25, more preferably from 12 to 22. R may include along the chain one or more aryl groups Preferably n is an interger from 9 to 100, more preferably from 10 to 80 and most preferably from 10 to 30. A preferably is an alkoxy group having from 2 to 6 carbon atoms and more preferably is propoxy and/or ethoxy.

Accordingly suitable alkoxylated nonionic surfactants for use herein are Dobanol®91-10 (R is a mixture of $C_9$ to $C_{11}$ alkyl chains, A is ethoxy, n is 10) or Luthensol AT® surfactants (where R is C16–C18 alkyl chain, A is ethoxy, n is from 10 to 80), or mixtures thereof. These Dobanol® surfactants are commercially available from SHELL, while these Luthensol AT® surfactants are commercially available from BASF.

Suitable chemical processes for preparing the alkoxylated nonionic surfactants for use herein include condensation of corresponding alcohols with alkylene oxide, in the desired proportions. Such processes are well known to the man skilled in the art and have been extensively described in the art.

The compositions herein may further comprise a filler like inorganic filler salts such as alkali metal carbonates, bicarbonates and sulphates. Such fillers for instance sodium bicarbonate, may also act as acidifying agent as described herein after. Accordingly, sodium bicarbonate and sodium sulphate are the preferred filler materials for use herein.

Typically, the compositions of the present invention comprise up to 50% by weight of the total composition of a filler or mixtures thereof, preferably from 0.1% to 20% and more preferably from 0.5 % to 10%.

The compositions herein typically also comprise an enzyme or a mixture thereof. Preferably the compositions herein comprise a protease or mixtures thereof. Protease enzymes are usually present in preferred embodiments of the invention at levels sufficient to provide from 0.005 to 0.2 Anson units (AU) of activity per gram of composition. The proteolytic enzyme can be of animal, vegetable or, preferably microorganism preferred origin. More preferred is serine proteolytic enzyme of bacterial origin. Purified or nonpurified forms of enzyme may be used. Proteolytic enzymes produced chemically or genetically modified mutants are included by definition, as are close structural enzyme variants. Particularly preferred by way of proteolytic enzyme is bacterial serine proteolytic enzyme obtained from Bacillus, Bacillus subtilis and/or Bacillus licheniformis. Suitable commercial proteolytic enzymes include Alcalase At, Esperase®, Durazym®, Savinase®, Maxatase®, Maxacal®, and Maxapem® 15 (protein engineered Maxacal); Purafect® and subtilisin BPN and BPN' are also commercially available. Preferred proteolytic enzymes also encompass modified bacterial serine proteases, such as those described in European Patent Application Serial Number 87303761.8, filed Apr. 28, 1987 (particularly pages 17, 24 and 98), and which is called herein "Protease B", and in European Patent Application 199,404, Venegas, published Oct. 29, 1986, which refers to a modified bacterial serine proteolytic enzyme, which is called "Protease A" herein. More preferred is what is called herein "Protease C", which is a triple variant of an alkaline serine protease from Bacillus in which tyrosine replaced valine at position 104, serine replaced asparagine at position 123, and alanine replaced threonine at position 274. Protease C is described in EP 90915958.4, corresponding to WO 91/06637, Published May 16, 1991, which is incorporated herein by reference. Genetically modified variants, particularly of Protease C, are also included herein.

Also suitable for use herein is a protease herein referred to as "Protease D" which is a carbonyl hydrolase variant having an amino acid sequence not found in nature, which is derived from a percursor carbonyl hydrolase by substituting a different amino acid for a plurality of amino acid residues at a position in said carbonyl hydrolase equivalent to position +76 in combination with one or more amino acid residue positions equivalent to those selected from the gorup consisting of +99, +101, +103, +107 and +123 in *Bacillus amyloliquefaciens* subtilisin as described in the concurrently filed patent applications of A. Baeck, C. K. Ghosh, P. P. Greycar, R. R. Bott and L. J. Wilson, entitled "Protease-Containing Cleaning Compositions" having U.S. Ser. No. 08/136,797 (P&G Case 5040), and "Bleaching Compositions Comprising Protease Enzymes" having U.S. Ser. No. 08/136,626, which are incorporated herein by reference.

Some preferred proteolytic enzymes are selected from the group consisting of Savinase®, Esperase®, Maxacal®, Purafect®, BPN', Protease A and Protease B, and mixtures thereof. Bacterial serine protease enzymes obtained from *Bacillus subtilis* and/or *Bacillus licheniformis* are preferred. Particularly preferred are Savinase®, Alcalase®, Protease A and Protease B.

Typically the compositions herein also comprise an amylase or a mixtures thereof. Engineering of enzymes for improved stability, e.g. oxidative stability is known. See, for example J. Biological Chem., vol. 260, No. 11, June 1985, pp 6518–6521. "Reference amylase" hereinafter refers to an amylase outside the scope of the amylase component of this invention and against which stability of any amylase within the invention can be measured.

The present invention thus makes use of amylases having improved stability in detergents, especially improved oxidative stability. A convenient absolute stability reference-point against which amylases used in the instant invention represent a measurable improvement is the stability of TERMAMYL (R) in commercial use in 1993 and available from Novo Nordisk A/S. This TERMAMYL (R) amylase is a "reference amylase". Amylases within the spirit and scope of the present invention share the characteristic of being "stability-enhanced" amylases, characterized, at a minimum, by a measurable improvement in one or more of: oxidative stability, e.g. to hydrogen peroxide/tetraacetylethylenediamine in buffered solution at pH 9–10; thermal stability, e.g. at common wash temperatures such as about 60° C.; or alkaline stability, e.g. at a pH from about 8 to about 11, all measured versus the above-idenfied reference-amylase. Preferred amylases herein can demonstrate further improvement versus more challenging reference amylases, the latter reference amylases being illustrated by any of the precursor amylases of which the amylases within the invention are variants. Such precursor amylases may themselves be natural or be the product of genetic engineering. Stability can be measured using any of the art-disclosed technical tests. See references disclosed in WO 94/02597, itself and documents therein referred to being incorporated by reference.

In general, stability-enhanced amylases respecting the invention can be obtained from Novo Nordisk A/S, or from Genencor International.

Preferred amylases herein have the common ability of being derived using site-directed mutagenesis from one or more of the *Bacillus amylases,* especially the *Bacillus alpha-amylases.* regardless of whether one, two or multiple amylase strains are the immediate precursors.

As noted, "oxidative stability-enhanced" amylases are preferred for use herein. Such amylases are non-limitingly illustrated by the following:

(a) An amylase according to the hereinbefore incorporated WO/94/02597, Novo Nordisk A/S, published Feb. 3, 1994, as further illustrated by a mutant in which substitution is made, using alanine or threonine (preferably threonine), of the methionine residue located in position 197 of the *Bacillus licheniformis* alpha-amylase, known as TERMAMYL (R), or the homologous position variation of a similar parent amylase, such as *Bacillus amyloliquefaciens, Bacillus subtilis,* or *Bacillus stearothermophilus;*

(b) Stability-enhanced amylases as described by Genencor International in a paper entitled "Oxidatively Resistant alpha-Amylases" presented at the 207th American Chemical Society National Meeting, Mar. 13–17, 1994, by C. Mitchinson. Therein it was noted that bleaches in automatic dishwashing detergents inactivate alpha-amylases but that improved oxidative stability amylases have been made by Genencor from *Bacillus licheniformis* NCIB8061. Methionine (Met) was identified as the most likely residue to be modified. Met was substituted, one at a time, in positions 8,15,197,256,304,366 and 438 leading to specific mutants, particularly important being M197L and M197T with the M197T variant being the most stable expressed variant. Stability was measured in CASCADE (R) and SUNLIGHT (R); Such enzymes are commercially available from Genencor under the trade name Plurafact Oxam®.

(c) Particularly preferred herein are amylase variants having additional modification in the immediate parent available from Novo Nordisk A/S. These amylases do not yet have a tradename but are those referred to by the supplier as QL37+M197T. Such enzymes are commercially available under the trade name SP 703 from Novo.

Any other oxidative stability-enhanced amylase can be used, for example as derived by site-directed mutagenesis from known chimeric, hybrid or simple mutant parent forms of available amylases.

The soaking compositions herein may also comprise a soil suspending agent or a mixture thereof, typically at a level up to 20% by weight, preferably from 0.1% to 10%, more preferably from 0.5% to 2%. Suitable soil suspending agents include ethoxylated diamines, ethoxylated polyamines, ethoxylated amine polymers as described in EP-A-112 593, incorporated herein by reference. Preferred soil suspending agents to be used herein include ethoxylated polyethyleneamine having a molecular weight of from 140 to 310 prior ethoxylation, ethoxylated 15–18 tetraethylenepentamine, ethoxylated 15–18 polyethylenamine, ethoxylated 15–18 ethylenediamine, ethoxylated polyethyleneimine having a molecular weight of from 600 to 1800 prior ethoxylation, and mixtures thereof.

Soaking compositions of the present invention may further comprise other optional ingredients such optical brighteners, other enzymes, other chelants, dispersants, soil release agents, photoactivated bleaches such as Zn phthalocyanine sulphonate, dyes, dye transfer inhibitors, pigments, perfumes and the like. Said optional ingredients can be added in varying amounts as desired.

B-The process:

The present invention encompasses processes of soaking fabrics. Indeed, the present invention encompasses a process of soaking fabrics, wherein said fabrics are immersed in a soaking liquor comprising water and an effective amount of a composition as described hereinbefore, for an effective period of time, then removed from said soaking liquor.

As used herein, the expression "process of soaking fabrics" refers to the action of leaving fabrics to soak in a soaking liquor comprising water and a composition as described hereinabove, for a period of time sufficient to clean said fabrics. In contrast to typical laundering operation using a washing machine, the soaking process herein allows prolonged contact time between the fabrics and the soaking liquor, typically up to 24 hours. The soaking process can be performed independently from any other process, such as a typical laundering operation, or a first step before a second, typical laundering step. In the preferred soaking processes of the invention, fabrics are left to soak for a period of time ranging from 10 minutes to 24 hours, preferably from 30 min to 24 hours, more preferably more than 1 hour to 24 hours, even more preferably 2 hours to 24 hours, and most preferably 4 hours to 24 hours. After the fabrics have been immersed in said soaking liquor for a sufficient period of time, they can be removed and rinsed with water. The fabrics can also be washed in a normal laundering operation after they have been soaked, with or without having been rinsed in-between the soaking operation and the subsequent laundering operation.

In the soaking process herein, a soaking composition described hereinabove is diluted in an appropriate amount of water to produce a soaking liquor. Suitable doses may range from 45 to 50 grams of soaking composition in 3.5 to 5 liters of water, down to 90 to 100 grams of soaking composition in 20 to 45 liters of water. Typically one dose is 45–50 grams in 3.5 to 5 liters for a concentrated soak (bucket/sink). For washing machine soaked, the dose is 90–100 grams in about 20 (Europe) to 45 (US) liters of water. The fabrics to be soaked are then immersed in the soaking liquor for an appropriate period of time. There are factors which may influence overall performance of the process on particulate dirt/soils. Such factors include prolonged soaking time. Indeed, the longer fabrics are soaked, the better the end results. Ideally, soaking time is overnight, i.e., 8 hours up to 24 hours, preferably 12 hours to 24 hours. Another factor is the initial warm or warmluke temperature. Indeed, higher initial temperatures of the soaking liquors ensure large benefits in performance.

The process herein is suitable for cleaning a variety of fabrics, but finds a preferred application in the soaking of socks, which are particularly exposed to silt and clay pick-up.

The Stain Removal Performance Test Method

The stain removal performance of a given composition on a soiled fabric under soaking conditions, may be evaluated by the following test method. Soaking liquors are formed by diluting for instance 45 g of the soaking compositions herein in 3.78 liter of water or 90 g of the soaking composition in 45 liters of water. Fabrics are then immersed in the resulting soaking liquor for a time ranging from more than 1 hour to 18 hours. Finally, the fabrics are removed from the soaking liquors, rinsed with water and washed with a regular washing process, handwash or washing machine wash, with a regular detergent, with or without re-using the soaking liquor, then said fabrics are left to dry.

For example, typical soiled fabrics to be used in this stain removal performance test may be commercially available from EMC (Empirical Manufacturing Company) Cincinnati, Ohio, USA, such as clay, grass, spaghetti sauce, gravy, dirty motor oil, make-up, barbecue sauce, tea, blood on two different substrates: cotton (CW120) and polycotton (PCW28).

The stain removal performance may be evaluated by comparing side by side the soiled fabrics treated with the soaking composition according to the present invention with those treated with the reference, e.g., the same soaking composition without such a sorbitan ester and/or anionic sulphonate surfactant according to the present invention. A visual grading scale may be used to assign differences in panel score units (psu), in a range from 0 to 4.

The following examples will further illustrate the present invention.

EXAMPLES

The following compositions are prepared by mixing the listed ingredients in the listed proportions.

| Ingredients | 1 (% w/w) | 2 (% w/w) | 3 (% w/w) |
|---|---|---|---|
| Sorbitan mono-stearate (SMS) | 0.5 | 0.5 | 0.5 |
| Citric acid | 11 | 11 | 8 |
| NOBS | 5 | 5 | 5 |
| Polyacrylate (Acusol 445ND) | 11 | 11 | 11 |
| Sodium percarbonate | 31 | 31 | 31 |
| NaPS | 1 | 2 | 2 |
| TAED | 5 | 5 | 3.5 |
| Anionic (LAS/AS/AES) | 8 | 8 | 8 |
| DTPA | 0.2 | 0.2 | 0.2 |
| Minors and inerts | up to 100 | up to 100 | up to 100 |

| | 4 (% w/w) | 5 (% w/w) | 6 (% w/w) |
|---|---|---|---|
| Sorbitan mono-stearate (SMS) | 2.5 | 0 | 0 |
| Sorbitan monostearate EO 20 (SMS EO 20) | 0 | 3.0 | 0 |
| Sorbitan tristearate EO 20 (STS EO 20) | 0.5 | 0 | 3.0 |
| Citric acid | 10 | 10 | 10 |
| Polyacrylate (Acusol 445 ND) | 11 | 11 | 11 |
| (C14–C16) NaPS | 2 | 2 | 0 |
| (C12–C14) NaPS | 0 | 0 | 2 |
| Sodium percarbonate | 31 | 31 | 31 |
| Sodium sulphate | 24 | 24 | 24 |
| NOBS | 6 | 6 | 6 |
| TAED | 5 | 5 | 5 |
| Anionic (LAS/AS/AES) | 7 | 7 | 7 |
| Others, inerts and minors | up to 100 | up to 100 | up to 100 |

| | 7 (% w/w) | 8 (% w/w) | 9 (% w/w) |
|---|---|---|---|
| Sorbitan mono-stearate (SMS) | 0.5 | 0.5 | 1 |
| Citric acid | 10 | 10 | 10 |
| Polyacrylate (Acusol 445 ND) | 11 | 11 | 11 |

-continued

| Ingredients | | | |
|---|---|---|---|
| Silicate (amorphous; 1.6 r) | 0.4 | 0.4 | 0.4 |
| Nonionic EO 25 alcohol | 2 | 2 | 2 |
| NaPS | 2 | 2 | 2 |
| Sodium percarbonate | 22 | 22 | 22 |
| Sodium sulphate | 24 | 24 | 24 |
| NOBS | 6 | 0 | 6 |
| TAED | 5 | 11 | 5 |
| Anionic (LAS/AS/AES) | 8 | 8 | 8 |
| Others, inerts and minors | up to 100 | up to 100 | up to 100 |

NaPS is sodium paraffin sulphonate
TAED is tetracetyl ethylene
NOBS is n-nonanoyloxybenzenesulphonate
DTPA is Diethylene-triamine-Penta Acetic acid.

Soaking liquors are formed by diluting each time 40–45 g of the above compositions in between 3.5 lit. to 5.0 lit. of water. 0.5 to 2 Kg of fabrics are then each time immersed in said soaking liquor for a time ranging from 10 minutes to 24 hours. Finally, the fabrics are removed from the soaking liquors, rinsed with water and washed with a regular washing process, handwash or washing machine wash, with a regular detergent, with or without re-using the soaking liquor, then said fabrics are left to dry. Excellent stain removal performance is obtained with these compositions on various stains including mud/clay stains, enzymatic stains, greasy stains, bleachable stains and the like.

What is claimed is:

1. A granular fabric soaking composition comprising:

a) from 0.001% to 15% by weight, of a sorbitan ester having the formula:

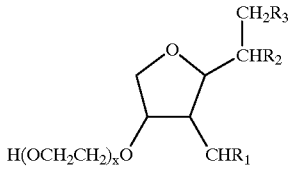

wherein $R_1$ and $R_2$ are each independently —OH, an acyl unit having the formula:

$$—OC(O)C_nH_{2n+1},$$

and mixtures thereof; $R_3$ is an acyl unit having the formula:

$$—OC(O)C_nH_{2n+1};$$

n is from 11 to 17; x is from 0 to 40;

b) from 0.001% to 20% by weight, of an anionic surfactant having the formula:

$$RSO_3M$$

wherein R is $C_6$–$C_{40}$ substituted or unsubstituted, linear or branched alkyl; $C_6$–$C_{40}$ substituted or unsubstituted, linear or branched alkenyl, and mixtures thereof; M is hydrogen or a water soluble cation;

c) from 0.01% to 80% by weight, of a bleaching agent, said bleaching agent selected from the group consisting of perborate, percarbonate, perphosphate, persilicate, persulphate, and mixtures thereof; and d) the balance carriers and adjunct ingredients.

2. A composition according to claim 1 comprising from 0.01% to 10% by weight, of said sorbitan ester.

3. A composition according to claim 2 comprising from 0.1% to 5% by weight, of said sorbitan ester.

4. A composition according to claim 3 comprising from 0.5% to 4% by weight, of said sorbitan ester.

5. A composition according to claim 1 wherein the index x is equal to 20.

6. A composition according to claim 1 wherein said sorbitan ester comprises one or more acyl units selected from the group consisting of stearoyl, palmitoyl, and mixtures thereof.

7. A composition according to claim 6 wherein said sorbitan ester comprises about 20 ethyleneoxy units.

8. A composition according to claim 1 wherein said sorbitan ester is selected from the group consisting of polyethoxylated (20) sorbitan tri-stearate, polyethoxylated (20) sorbitan mono-stearate, sorbitan mon-ostearate, sorbitan mon-opalmitate, and mixtures thereof.

9. A composition according to claim 1 comprising form 0.01% to 15% by weight of said anionic surfactant.

10. A composition according to claim 9 comprising from 0.1% to 10% by weight, of said anionic surfactant.

11. A composition according to claim 10 comprising from 0.5% to 5% by weight, of said anionic surfactant.

12. A composition according to claim 1 wherein said composition comprises from 05% to 45% by weight, of said oxygen bleach.

13. A composition according to claim 12 wherein said composition comprises from 10% to 40% by weight, of said oxygen bleach.

14. A composition according to claim 1 further comprising up to 30% by weight, of a bleach activator.

15. A composition according to claim 14 wherein said bleach activator is selected from the group consisting of nonanoyloxybenzenesulphonate, nonylamide of peroxyadipic acid, benzoyl caprolactam, octanoyl caprolactam, nonanoyl caprolactam, tetraacetyl ethylenediamine, diperoxy dodecanoic acid, and mixtures thereof.

16. A composition according to claim 11 wherein said adjunct ingredients are selected from the group consisting of acidifying agents, alkali metal salts of silicate, builders, soil suspending agents, fillers, other surfactants, optical brighteners, enzymes, chelating agents, dispersants, soil release agents, dyes, dye transfer inhibitors, pigments, perfumes, and mixtures thereof.

17. A granular fabric soaking composition comprising:

a) from 0.001% to 15% by weight, of a sorbitan ester having the formula:

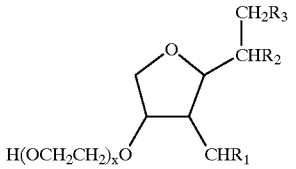

wherein $R_1$ and $R_2$ are each independently —OH, palmitoyl, stearoyl, and mixtures thereof; $R_3$ is palmitoyl, stearoyl, and mixtures thereof; x is 20;

b) from 0.001% to 20% by weight, of an anionic surfactant having the formula:

$$RSO_3M$$

wherein R is $C_6$–$C_{40}$ substituted or unsubstituted, linear or branched alkyl; $C_6$–$C_{40}$ substituted or unsubstituted, linear or branched alkenyl, and mixtures thereof; M is hydrogen or a water soluble cation;

c) a bleaching system comprising:

i) from 0.01% to 80% by weight, of a bleaching agent, said bleaching agent selected from the group consisting of perborate, percarbonate, perphosphate, persilicate, persulphate, and mixtures thereof;

ii) up to 30% by weight, of a bleach activator, said bleach activator is selected from the group consisting of nonanoyloxybenzenesulphonate, nonylamide of peroxyadipic acid, benzoyl caprolactam, octanoyl caprolactam, nonanoyl caprolactam, tetraacetyl ethylenediamine, diperoxy dodecanoic acid, and mixtures thereof; and d) the balance carriers and adjunct ingredients, said adjunct ingredients are selected from the group consisting of acidifying agents, alkali metal salts of silicate, builders, soil suspending agents, fillers, other surfactants, optical brighteners, enzymes, chelating agents, dispersants, soil release agents, dyes, dye transfer inhibitors, pigments, perfumes, and mixtures thereof.

18. A method for treating fabric comprising the step of soaking fabric in an aqueous solution containing from 1.8% by weight of a composition comprising:

a) from 0.001% to 15% by weight, of a sorbitan ester having the formula:

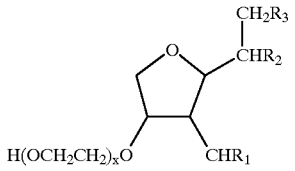

wherein $R_1$ and $R_2$ are each independently —OH, an acyl unit having the formula:

$$—OC(O)C_nH_{2n+1},$$

and mixtures thereof; $R_3$ is an acyl unit having the formula:

$$—OC(O)C_nH_{2n+1};$$

n is from 11 to 17; x is from 0 to 40;

b) from 0.001% to 20% by weight, of an anionic surfactant having the formula:

$$RSO_3M$$

wherein R is $C_6$–$C_{40}$ substituted or unsubstituted, linear or branched alkyl; $C_6$–$C_{40}$ substituted or unsubstituted, linear or branched alkenyl, and mixtures thereof; M is hydrogen or a water soluble cation;

c) from 0.01% to 80% by weight, of a bleaching agent, said bleaching agent selected from the group consisting of perborate, percarbonate, perphosphate, persilicate, persulphate, and mixtures thereof; and d) the balance carriers and adjunct ingredients.

19. A method according to claim 18 wherein said fabric is soaked in said composition for a period of time from 10 minutes to 24 hours.

20. A method according to claim 19 wherein said fabric is soaked in said composition for a period of time from 30 minutes to 24 hours.

* * * * *